US005323583A

United States Patent [19]

Venegas, Jr.

[11] Patent Number: 5,323,583

[45] Date of Patent: Jun. 28, 1994

[54] STANCHION WITH SLEEVE AND METHOD OF USING SAME

[75] Inventor: Frank Venegas, Jr., 4165 Homestead, Howell, Mich. 48843

[73] Assignee: Frank Venegas, Jr., Howell, Mich.

[21] Appl. No.: 38,676

[22] Filed: Mar. 26, 1993

[51] Int. Cl.[5] ..... E04C 3/30

[52] U.S. Cl. ..... 52/727; 52/301; 256/1

[58] Field of Search ..... 52/727, 244, 300, 301, 52/728; 256/1, 19

[56] References Cited

U.S. PATENT DOCUMENTS 2,450,345 9/1948 Kervin ..... 52/301
4,244,156 1/1981 Watts, Sr. ..... 52/728 X
4,961,258 10/1990 Manzel ..... 52/728 X
5,222,344 6/1993 Johnson ..... 52/728 X

*Primary Examiner*—Carl O. Friedman
*Assistant Examiner*—Creighton Smith
*Attorney, Agent, or Firm*—Gifford, Groh, Sprinkle, Patmore and Anderson

[57] ABSTRACT

A stanchion with sleeve includes an elongated member secured to a fixed structure and extending generally linearly away from the fixed structure. The sleeve has an elongated body extending curvilinearly between two opposing ends. An interior cavity extends along the sleeve and through one end of the sleeve. The interior cavity has a cross-sectional shape adapted for slip fit engagement with the stanchion post. The sleeve is formed with a curve for receiving the stanchion post in the interior cavity in force fit engagement.

18 Claims, 3 Drawing Sheets

STANCHION WITH SLEEVE AND METHOD OF USING SAME

BACKGROUND OF THE INVENTION

The present invention generally relates to guard rails, and more particularly relates to a protective stanchion or post.

Guard rail systems, including individual stanchions or posts, are commonly found in industrial settings where, for example, protection of a building structure or fixed equipment, from vehicular traffic and the like is desired. Further, guard posts or protective stanchions are commonly found in public parking lots and the like to preserve a drive-up telephone booth, for example, or otherwise provide a protective function.

Commonly known guard posts and protective stanchions often comprise a steel post set in the ground or pavement with a portion of the post projecting a desired amount above the pavement surface, commonly on the order of about four feet or so. To enhance the durability of such a steel pipe stanchion, one may fill the steel pipe with concrete. This both closes the interior of the pipe to environmental deterioration and enhances the structural integrity and impact absorbing qualities of the stanchion. Further, such stanchions are typically painted to preserve the exterior of the stanchion and resist deterioration by rusting or the like. Protective stanchions are also painted to provide a high visibility color for the stanchion.

However, such prior known steps to enhance the durability of a protective stanchion, including painting, are typically labor-intensive and require repetitive maintenance to repair chipped paint, worn surfaces, or discoloration over time. Thus, one will readily recognize a present need for a protective stanchion with a durable exterior to minimize repetitive maintenance requirements.

SUMMARY OF THE INVENTION

The above addressed failings of present protective stanchions and the identified need for a low maintenance protective stanchion are addressed by the present invention which provides a clever assembly of a stanchion post and protective sleeve. The post is an elongated member having one end secured to a fixed structure. The post extends generally linearly away from the one end, at the fixed structure, to an opposing terminal end. A sleeve is provided, having an elongated body extending generally curvilinearly between two opposing ends. The sleeve has an interior cavity extending along the sleeve and through at least one of the two opposing ends. Further, the interior cavity has a cross-sectional shape adapted for slip fit engagement with the post. The post is inserted into the interior cavity and the sleeve force fit over the post.

These and other features, objects, and benefits of the invention will be recognized by those skilled in the art, from the specification, the claims which follow, and the attached drawings.

DESCRIPTION OF THE PREFERRED EMBODIMENTS

Figure 1:
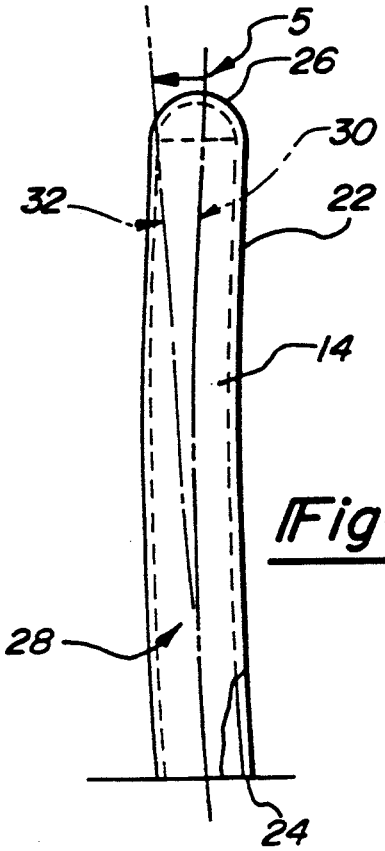
FIG. 1 is a side elevational view of a sleeve for a protective stanchion according to the invention.

A preferred embodiment of a protective stanchion according to the invention is generally shown in the figures and indicated by the reference numeral 10. Stanchion 10 comprises an elongated member of post 12 and a sleeve 14.

Figure 2:
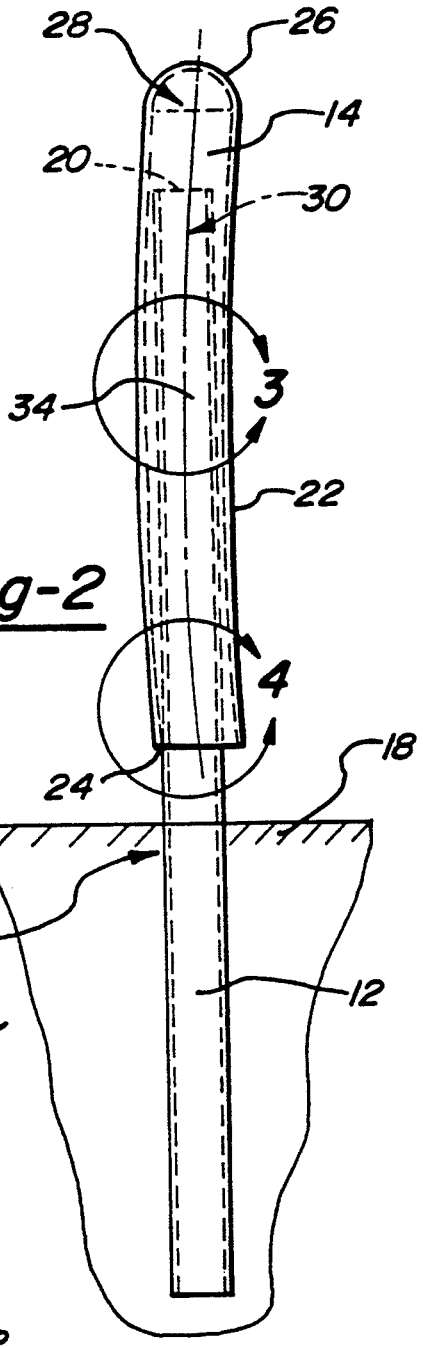
FIG. 2 is a side elevational view of a protective stanchion according to the invention in a partially assembled state.
Figure 5:
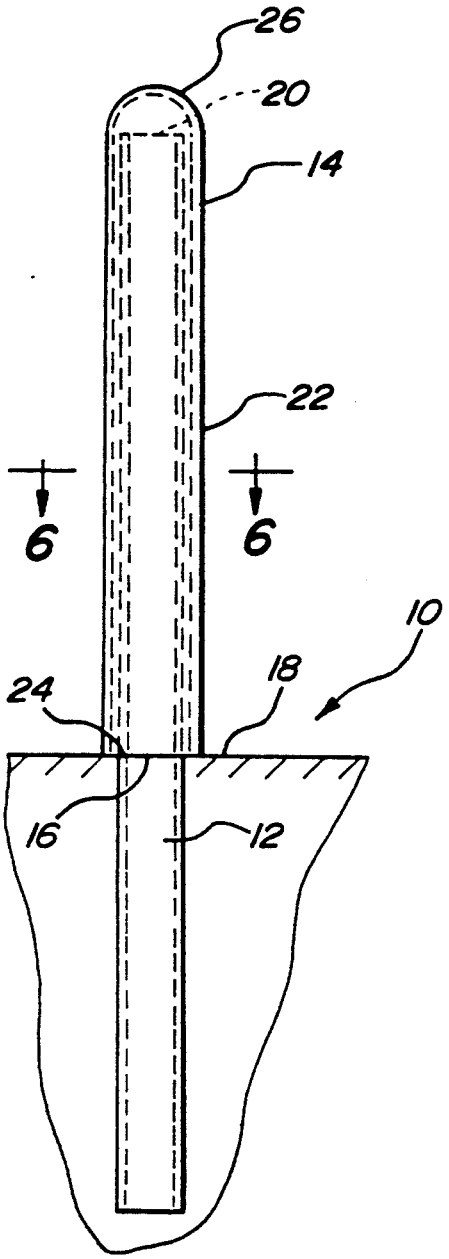
FIG. 5 is the view of FIG. 2 with the stanchion fully assembled.

As shown in FIGS. 2 and 5, post 12 is secured at a first end 16 to a fixed structure 18, and extends generally linearly away from fixed structure 18 to an opposing terminal end 20. Post 12 will extend about four feet from first end 16 to terminal end 20, but this distance may vary and be adapted according to the requirements of the particular installation.

Post 12 may be any suitable elongated structural member, and is most preferably a length of structural steel pipe, ranging in size from about three inches to about eight inches in diameter and having a wall thickness commonly designated by "standard strength" or schedule 40 (SCH 40) pipe, "extra strong", or "double extra strong" as is known in the trade. The requirements of the specific installation will dictate the size and strength of post 12, which may range beyond the above examples. Further, post 12 may include structural members other than steel pipe, which typically has a circular cross-sectional shape, and may also include, but not be limited to, members having other geometric or irregular cross-sectional shapes.

First end 16 extends into fixed structure 18, and preferably extends about three feet into fixed structure 18 (FIGS. 2 and 5). Again, depending upon the specific installation, the length which first end 16 extends into fixed structure 18 may also be varied. If fixed structure 18 is the ground, for example, the length of first end 16 may be dictated by local frost conditions, which may require that first end 16 extend about four to five feet into fixed structure 18 to avoid winter frost heaving and displacement of stanchion 10.

While FIGS. 2 and 5 may give the impression that stanchion 10 extends only generally vertically upwardly from a generally horizontal surface of fixed structure 18, stanchion 10 is not constrained to a particular spacial origin or origin relative to fixed structure 18. Rather, stanchion 10 may be oriented in any manner according to the requirements of the specific installation.

Figure 3:
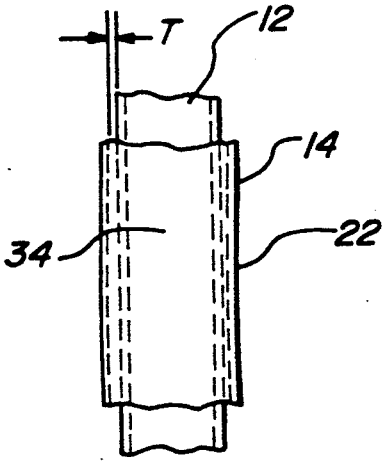
FIG. 3 is an enlarged view of detail III of FIG. 2.
Figure 4:
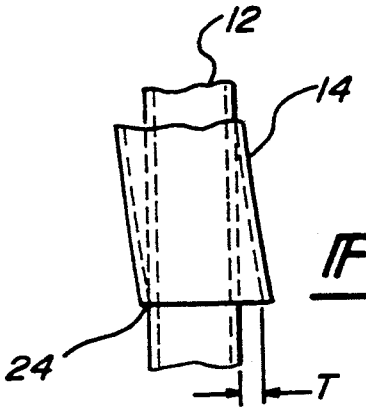
FIG. 4 is an enlarged view of detail III of FIG. 3.

Sleeve 14 has an elongated body 22 extending generally curvilinearly between two opposing ends 24 and 26 (FIG. 1). An interior cavity 28 extends along sleeve 14 and through at least one of the two opposing ends 24 and 26. Most preferably, cavity 28 extends through only one end 24 and the opposing end 26 is closed to provide protection for post 12. Cavity 28 has a cooperating cross-sectional shape adapted to receive post 12 in slip fit engagement with a clearance "T," as shown in FIGS. 3 and 4.

Sleeve 14 may be formed of a number of suitable, malleable structural materials, and is preferably formed of a structural plastic, including, for example, generally available low density polyethylenes and LEXAN TM brand polycarbonate, available from General Electric Company. Sleeve 14 is conveniently molded by well-known rotary molding processes. As is also known in the molding of plastics, various coloring agents may be mixed into the material of which sleeve 14 is formed to provide a durable coloring throughout sleeve 14, and a variety of material enhancing additives may be used, including, but not limited to, additives to resist ultraviolet (UV) deterioration, for example.

As commented above, sleeve 14 extends curvilinearly between opposing ends 24 and 26, and more specifically, sleeve 14 extends along a curve 30 (FIGS. 1 and 2). Curve 30 is spaced at least about one-half inch to about eight inches away from a tangent line 32 at a distance of about four feet from the intersection of tangent line 32 with curve 30, as shown at "S" in FIG. 1. The curvature of sleeve 14 may be specifically formed into the sleeve during molding. The curvature of sleeve 14 may also be formed by molding sleeve 14 as a straight cylindrical member, removing sleeve 14 from a fabrication mold while still hot, and supporting sleeve 14 on a cooling rack, near the ends 24 and 26, to allow the sleeve to sag and, thus, acquire the curvature.

Stanchion 10 is assembled by inserting terminal end 20 of post 12 through end 24 of sleeve 14 and into cavity 28 (FIG. 2). Because cavity 28 has a cooperating cross-sectional shape adapted to receive post 12 in slip fit engagement, as discussed above, terminal end 20 and post 12, generally, are readily received in cavity 28, and sleeve 14 is initially slipped over post 12 with relative ease. However, as sleeve 14 slides over post 12 toward first end 16, the curvature of sleeve 14 causes binding between the sleeve and post 12. As shown in FIGS. 2–4, the curvature of sleeve 14 will bias post 12 against one side of cavity 28 at end 24, bias terminal end 20 against the same side of cavity 28 near end 26, and bias a mid-portion 34 of post 12 against an opposing side of cavity 28. Thus, as sleeve 14 slides over post 12, binding between curvilinear sleeve 14 and linear post 12 generates a resistance so that sleeve 14 must ultimately be force fit into its final position on post 12 and sleeve 14 is, thus, securely mounted on post 12 and resists subsequent removal (FIG. 5).

Figure 7:
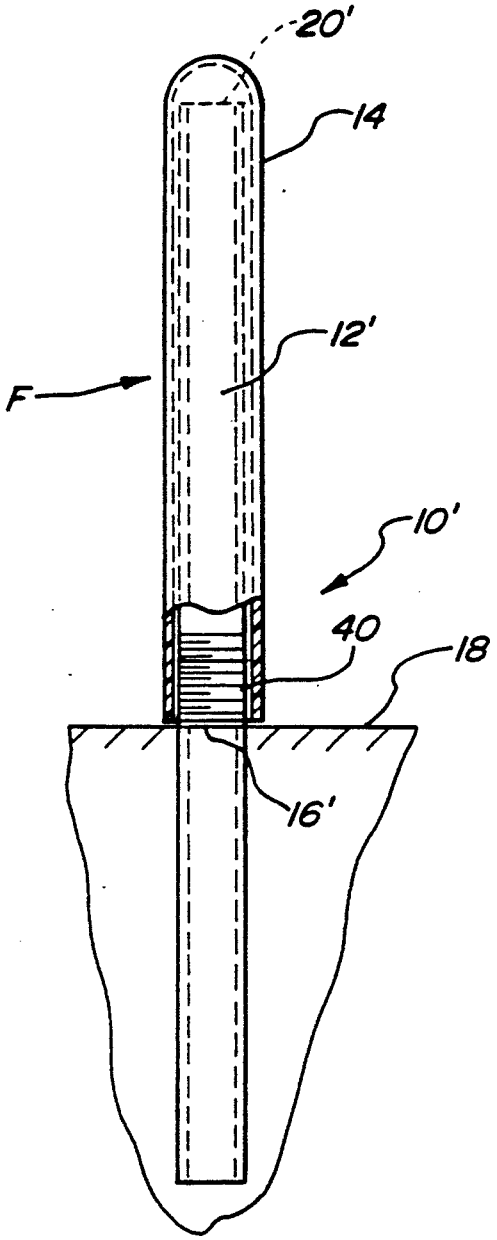
FIG. 7 is a side elevational view of a second embodiment of a protective stanchion according to the invention.
Figure 6:
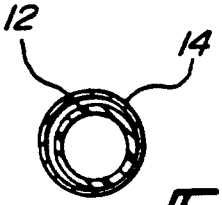
FIG. 6 is a cross-sectional view taken along line VI—VI of FIG. 5.

In a second embodiment 10′ of stanchion 10, as shown in FIG. 7, post 12′ is provided with a resilient portion 40 near first end 16′ so that terminal end 20′ may deflect generally arcuately about first end 16′ from an original position to a deflected position, when a generally lateral force "F" is applied to post 12′, between first end 16′ and terminal end 20′, as may occur when stanchion 10′ is struck by a vehicle, for example. Resilient portion 40 may be a helical coil spring, a leaf spring mount, or a resilient rubber-like insert, and the like which biases terminal end 20′ toward its original position so that when force F is removed, terminal end 20′ returns from the deflected position to its original position. Including resilient portion 40 in stanchion 10′ minimizes damage caused to stanchion 10′ and to a striking vehicle or the like without compromising the boundary defining function of stanchion 10′.

Figure 8:
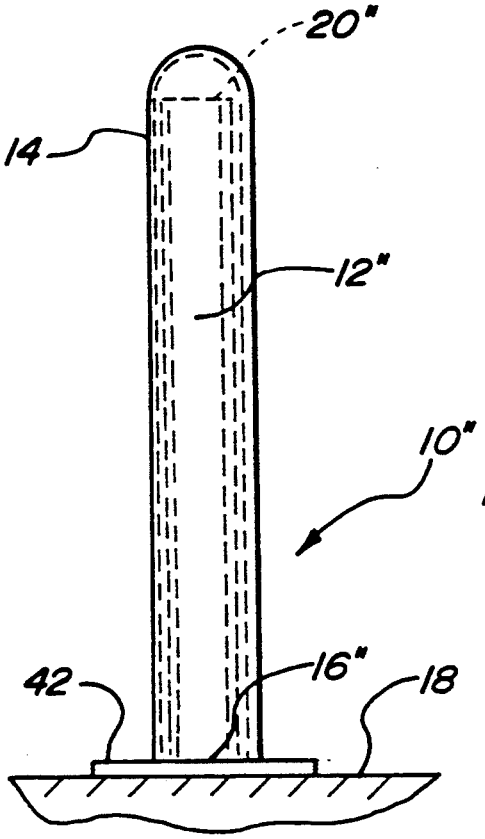
FIG. 8 is a side elevational view of a third embodiment of a protective stanchion according to the invention.
Figure 9:
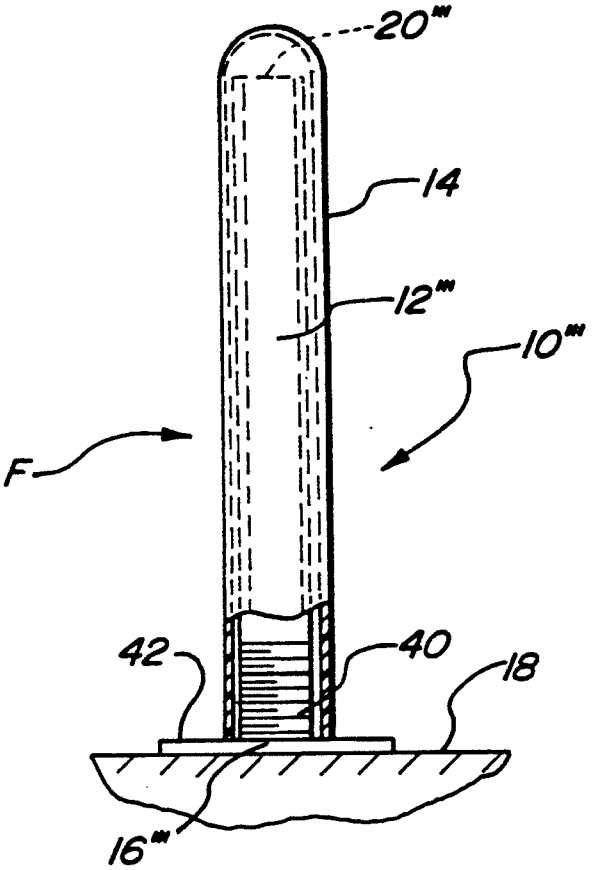
FIG. 9 is a side elevational view of a fourth embodiment of a protective stanchion according to the invention.

A third embodiment 10″ of stanchion 10 is shown in FIG. 8. According to this embodiment, stanchion 10″ has a flange 42 at first end 16″ for bolting stanchion 10″ to fixed structure 18. A fourth embodiment 10‴ of stanchion 10 is shown in FIG. 9, and combines the resilient portion 40 and flange 42 features of stanchions 10′ and 10″.

It will be understood by one skilled in the art that various modifications and improvements may be made without departing from the spirit of the disclosed concept. The scope of protection afforded is to be determined by the following claims and by the breadth of interpretation allowed by law.

The embodiments of the invention in which an exclusive property or privilege is claimed are defined as follows:

1. A stanchion comprising:

an elongated member having a first end secured to a fixed structure, said elongated member extending generally linearly, away from said first end to an opposing terminal end; and a sleeve having an elongated body extending generally curvilinearly between two opposing ends, said sleeve having an interior cavity extending along said sleeve and through one of said two opposing ends, said interior cavity having a cross-sectional shape adapted to receive said elongated member in slip fit engagement, said elongated member being positioned in said interior cavity and being received in force fit engagement in said interior cavity.

2. The stanchion defined in claim 1 wherein:

said sleeve extends curvilinearly along a curve;

a tangent line intersects said curve at a common point; and said curve is spaced from about one-half inch to about eight inches away from said tangent line at a distance of about four feet from said common point.

3. The stanchion defined in claim 2 wherein said elongated member has a length from said first end to said terminal end, said interior cavity has a length, and said elongated member length and said internal, cavity length are about equal.

4. The stanchion defined in claim 3 wherein the other of said two opposing ends of said sleeve is closed, defining one end of said interior cavity.

5. The stanchion defined in claim 4 wherein said terminal end of said elongated member is positioned adjacent said one end of said interior cavity.

6. The stanchion defined in claim 5 wherein said first end of said elongated member extends into the fixed structure and said elongated member is cantilevered out from the fixed structure.

7. The stanchion defined in claim 5 wherein said first end of said elongated member has a flange, said flange is fastened to the fixed structure, and said elongated member is cantilevered out from the fixed structure.

8. The stanchion defined in claim 2 wherein said elongated member further includes a resilient portion near said first end so said terminal end moves generally arcuately from an original position to a deflected position when a force, acting generally perpendicular to said stanchion, is applied to said stanchion and said terminal end returns to about said original position when the force is removed.

9. The stanchion defined in claim 8 wherein said sleeve extends over at least a portion of said elongated member from said terminal end toward said first end.

10. The stanchion defined in claim 8 wherein the other of said two opposing ends of said sleeve is closed, defining one end of said interior cavity.

11. The stanchion defined in claim 10 wherein said terminal end of said elongated member is positioned adjacent said one end of said interior cavity.

12. The stanchion defined in claim 11 wherein said first end of said elongated member extends into the fixed structure and said elongated member is cantilevered out from the fixed structure.

13. The stanchion defined in claim 11 wherein said first end of said elongated member has a flange, said flange is fastened to the fixed structure, and said elongated member is cantilevered out from the fixed structure.

14. A sleeve to at least partially encase a stanchion, comprising:

an elongated body extending generally curvilinearly between a first end and an opposing second end; and an interior cavity extending along said sleeve and through one of said first end and said second end, said interior cavity having a cross-sectional shape adapted to receive the stanchion in slip fit engagement, said sleeve receiving the stanchion in said interior cavity in force fit engagement.

15. The sleeve defined in claim 14 wherein:

said sleeve extends curvilinearly along a curve;

a tangent line intersects said curve at one of said first end and said second end; and said curve is spaced from about one-half inch to about eight inches away from said tangent line at a distance of about four feet from said one of said first end and said second end.

16. The sleeve defined in claim 15 wherein the other of said first end and said second end of said sleeve is closed, defining one end of said interior cavity.

17. The method of using a stanchion sleeve to at least partially encase a stanchion, comprising the steps of:

providing a stanchion;

providing a sleeve having an elongated body with two opposing ends and an interior cavity extending along said elongated body and through one end of said elongated body;

forming said interior chamber with a cross-sectional shape adapted to receive said stanchion in slip fit engagement;

forming a curve in said elongated body so that said sleeve receives said stanchion in said interior cavity in force fit engagement;

inserting said stanchion into said interior cavity; and forcing said sleeve onto said stanchion, to a desired position on said stanchion, to at least partially encase said stanchion.

18. The method defined in claim 17 wherein said step of forming a curve further includes forming said curve so that said curve is spaced from about one-half inch to about eight inches away from a tangent line which intersects said curve at one of said two opposing ends of said sleeve, said spacing of said curve from said tangent line being measured at a distance of about four feet away from said intersection of said tangent line with said curve.

* * * * *